United States Patent [19]

Patrie et al.

[11] 4,115,212

[45] Sep. 19, 1978

[54] ELECTROLYTIC COLORING PROCESS FOR NON ANODIZED ALUMINUM AND ITS ALLOYS

[75] Inventors: Jos Patrie, Grenoble; Gabriel Colombier, Saint Egreve, both of France

[73] Assignee: Societe de Vente de l'Aluminium Pechiney, Paris, France

[21] Appl. No.: 876,356

[22] Filed: Feb. 9, 1978

[30] Foreign Application Priority Data

Feb. 11, 1977 [FR] France ..... 77 04639

[51] Int. Cl.[2] ..... C25D 5/30; C25D 5/48

[52] U.S. Cl. ..... 204/38 E; 204/35 N

[58] Field of Search ..... 204/35 N, 38 A, 42, 204/38 E

[56] References Cited

U.S. PATENT DOCUMENTS

| | | | |
|---|---|---|---|
| 3,382,160 | 5/1968 | Asada | 204/35 N |
| 3,717,555 | 2/1973 | Chakravarti et al. | 204/35 N |
| 4,024,039 | 5/1977 | Yoshida et al. | 204/38 E |

*Primary Examiner*—John H. Mack
*Assistant Examiner*—William Leader
*Attorney, Agent, or Firm*—McDougall, Hersh & Scott

[57] ABSTRACT

Electrolytic coloring process for the surface of aluminum or aluminum alloy objects such as designed for the interior or exterior of buildings or even simpler objects such as ski poles, etc., characterized in that the object, without having been previously anodized, is directly subjected to the action of an alternating current at a voltage below the anodization voltage of the aluminum in an aqueous bath consisting of sulfuric acid and boric acid or only sulfamic acid, at least one salt of copper, tin, silver, nickel or gold; the resultant colored film is then coated with a colorless varnish.

14 Claims, No Drawings

ELECTROLYTIC COLORING PROCESS FOR NON ANODIZED ALUMINUM AND ITS ALLOYS

The present invention pertains to an electrolytic coloring process, used for decorative purposes, for aluminum or aluminum alloy parts, the surfaces of which have not previously undergone any anodization treatment.

In this text, the word "aluminum" will refer to both the pure metal and its alloys.

The first phase of most aluminum coloring processes presently known consists in anodizing the metal to be colored, i.e., subjecting it to an electric current while it is immersed in an adequate conducting solution. Under these conditions, a more or less porous oxide coat develops on the metal surface. During the second phase, organic colorants are deposited in the pores of the said coat by simple immersion in baths consisting of these products or better yet or colored pigments obtained by alternating current electrolysis in an aqueous solution of metallic salts. Processes such as these have been patented in France: for example ASADA Pat. No. 1,505,185, ANOLOK Pat. No. 1,477,823 and CEGEDUR Pat. No. 2,142,828. Others carry out this coloring process only by alternating current electrolysis in the presence of dissolved metallic salts, during which there is both anodization of the aluminum and surface depositing of colored oxides from electrolysis bath. This is the case in the process described by Langbein and Pfanhauser in French Pat. No. 322,498.

All these methods require an aluminum surface having an oxide coat with the following defined characteristics: sufficient thickness so as to obtain dark colors; porosity capable of adequately absorbing the colorant; consistent thickness and porosity so as to obtain uniform coloring; to avoid corrosion of the substrate, complete elimination of the anodization electrolyte; and finally adequate quality of the metal to be colored.

Thus, these conditions call for a difficult, more or less time consuming technique, costly in electricity because of the minimum oxide thicknesses required which are usually approximately several tens of microns. Furthermore, once coloring is obtained, a plugging operation of the oxide coat must be undertaken to fix the coloring and make it resistant to environments to which it will be exposed. In spite of these precautions, it turns out that, for certain methods, as for example in the case of organic coloring, the colors obtained are not very lightfast. In addition, some mechanical surface deterioration sometimes results in unsightly color variations.

This application is concerned with obviating the difficulties faced in all the prior techniques, and has for its object the development of a simple, economical process for producing a wide range of new colors when compared to the palettes obtained up to now and which would keep their sheen no matter where and how long they are exposed to light, and with the additional property of reflecting the original appearance of the base metal; shiny, dull, glossy, etc.

The electrolytic coloring process for aluminum parts, in accordance with the practice of this invention, is characterized in that the part to be colored, without having been previously anodized, is subjected to the action of an alternating current, for less than 10 minutes, at a voltage under the anodization voltage of aluminum, in a bath at ambient temperature with a pH less than 2, in which the bath consists of boric acid, at least one salt of a metal from the copper, tin, silver, nickel and gold group and the anion of which belongs to the sulfate, sulfamate and chloride group; the part thusly colored is then coated with a transparent varnish.

One of the characteristics of the invention consists, therefore, in taking a not previously anodized aluminum part, i.e., which has not undergone any surface oxidation treatment by electrolysis. Of course, according to the desired results, this surface could undergo certain initial processes such as mechanical polishing, burnishing or polishing, if a shiny appearance is desired; fine sanding, shot-blasting or chemical converting, if a dull surface is desired; brushing, rough sanding or scouring if a glossy appearance is desired. Most often, the treatment is limited to simple metal degreasing by means of known solvents, such as trichloroethylene or perchloroethylene. But, in no case is the part subjected to prior anodization.

Having thus defined the state of the part to be colored, the process in the invention is applied to it, namely: to incorporate it as an electrode in an aqueous electrolysis circuit where, under the combined action of different factors (time, nature of the current, voltage, temperature, composition of the bath, pH), the desired coloring develops.

These different factors are specified as follows:

exclusive utilization of alternating current, any polarization, even short, prevents coloring from occuring. This current is passed in the circuit for a time which varies according to the desired color and the other electrolysis conditions, but which is between 30 seconds and 10 minutes.

The voltage applied also depends on other electrolysis criteria and is between 2 and 12 volts, but it should comply with the requirement of not reaching the bias voltage of the aluminum which would result in aluminum oxide appearing on the surface of the part to be colored and in the destruction of the colored film. The current density, initially in the neighborhood of 1 A/dm2, decreases rapidly at the beginning of the operation and is stabilized at values which vary according to the composition of the bath and which are situated around 0.3 to 0.8 A/dm2.

The process adapts itself very well to ambient temperature and no input and heat flow regulation operation is required.

The bath in which the aluminum part to be colored is dipped has the following characteristics:

pH less than 2, so as to stay in an acidity zone where only the colored metal deposits can be produced, presence of $H_3BO_3$ boric acid which acts as a buffer on the acidity in the medium, its concentration being less than 50g/l.

presence of either sulfuric acid or sulfamic acid, their quantities being approximately 2 g/l for the first and 2 to 10 g/l for the second.

presence of one or several metal salts such as copper, tin, silver, nickel or gold, the anions of which are selected from the sulfates, sulfamates and chlorides, the quantity depending on the metal considered, but in all cases, less than 50 g/l. The counter electrode will consist preferably of a metal of the same nature as that of the salt used.

Under these conditions, electrolysis leads to the formation of a very thin colored film, less than 1 micron thick, at the surface of the aluminum part.

As the last of its characteristics, after careful rinsing in demineralized water and air drying, the process of this invention includes treating the resultant film by soaking it in a colorless acrylic varnish of a known type which, after oven drying, between 100° and 150° C, constitutes a protective covering for the aluminum part and makes it shine.

The invention can be modified so that the use of boric acid can be discontinued when a sulfamic acid solution is used in the electrolysis bath.

The process thus described allows for obtaining a color range practically covering the entire spectrum, from red to yellow to green to blue to indigo, not to mention the compound colors like the greys, the bronzes and the browns.

In addition to the fact that the metallic substrate keeps its original appearance under the colored film, this wide range makes this process a choice method for obtaining parts designed for the interior and exterior decoration of buildings and even for simpler objects such as ski poles, etc., especially since the resultant coloring is light-fast and doesn't undergo any change, even after prolonged exposure to ultraviolet rays. Moreover, the method proposed can be applied to the coloring of aluminum bands by a continuous treatment.

The examples in the following table are given for better illustration of the invention. For this purpose, the following has been grouped together:

the nature of the metal to be colored, identified as $A_4$, $A_5$, $A_9$ which respectively contain 99.4, 99.5 and 99.99% aluminum, and as A-Z5G for an aluminum alloy containing 5% zinc and magnesium the treatment time in minutes the voltage applied in volts the pH of the electrolysis bath the bath composition.

TABLE

| Example No. | Nature of Colored Metal | Electrolytic Treatment Time in Minutes | Voltage Applied in Volts | Electrolytic Bath pH | Bath Composition in g/l. | Color Obtained |
|---|---|---|---|---|---|---|
| 1 | $A_5$ | 2 | 9 | 1.5 | Boric Acid $H_3BO_3$ : 20 Copper-Sulfate $CuSO_4$ : 5 Sulfuric Acid $H_2SO_4$ : 2 | greenish-yellow |
| 2 | $A_4/A_9$ | 3 | 8 | 1.5 | Identical to example 1 | red |
| 3 | $A_5$ | 3 | 9 | 1.4 | Tin Sulfate $SnSO_4$ : 5 $H_3BO_3$ : 20 $H_2SO_4$ : 2 | grey |
| 4 | A-Z5G | 2 | 6 | 1.4 | Silver Sulfate $Ag_2SO_4$ : 0.5 $H_3BO_3$ : 20 $H_2SO_4$ : 2 | yellow |
| 5 | A-Z5G | 0.5 | 8 | 1.7 | Nickel Sulfate $NiSO_4,7H_2O$ : 15 $H_3BO_3$ : 30 $H_2SO_4$ : 2 | bronze |
| 6 | A-Z5G | 1 | 8 | 1.2 | Gold Chloride $AuCl_3$ : 0.1 $H_3BO_3$ : 20 $H_2SO_4$ : 2 | Light blue |
| 7 | A-Z5G | 1.5 | 8 | 0.9 | Sulfamic Acid $HSO_3NH_2$ : 10 $CuSO_4$ : 5 | greenish-yellow |
| 8 | $A_5$ | 6 | 10 | 1.5 | $HSO_3NH_2$ : 2.5 $AuCl_3$ : 0.025 a.05 | steel blue |
| 9 | A-Z5G | 2 | 8 | 1.6 | $HSO_3NH_2$ : 2.5 $NiSO_4,7H_2O$ : 15 | light bronze |
| 10 | A-Z5G | 2 | 8 | 1.5 | $HSO_3NH_2$ : 2 $SnSO_4$ : 5 | dark grey |
| 11 | $A_5$ | 3 | 8 | 1.4 | $HSO_3NH_2$ : 2.5 $NiSO_4,7H_2O$ : 15 $SnSO_4$ : 5 | grey with reddish sheen |
| 12 | A-Z5G | 3 | 8 | 1.4 | $H_2SO_4$ : 2 $H_3BO_3$ : 20 $CuSO_4$ : 5 $AuCl_3$ : 0.125 | bronze grey |

We claim:

1. A process for electrolytic coloring of objects of aluminum and alloys of aluminum comprising subjecting the objects, without previous anodization, to alternating current, at a voltage below the anodization voltage of the aluminum, while immersed in an aqueous bath having a pH less than 2 and containing boric acid, at least one acid from the group consisting of sulfuric acid, sulfamic acid and mixtures thereof, and at least one salt of a metal selected from the group consisting of copper, tin, silver, nickel and gold, the anion of which is selected from the group consisting of sulfate, sulfamate and chloride, and then coating the colored surface of the object with a colorless varnish.

2. The process as claimed in claim 1 in which the object is subjected to the alternating current for a time less than 10 minutes.

3. The process as claimed in claim 1 in which the object is subjected to the alternating current for a time within the range of 30 seconds to 10 minutes.

4. The process as claimed in claim 1 in which the colored bath is at about ambient temperature.

5. The process as claimed in claim 1 in which the object is subjected to alternating currents of 2 to 10 volts.

6. The process as claimed in claim 1 in which the object is subjected to alternating current at a current density of 0.3 to 0.8 A/dm2 during the steady state.

7. The process as claimed in claim 1 in which the boric acid is present in the bath in a concentration of less than 50 g/l.

8. The process as claimed in claim 1 which when sulfuric acid is present in the bath, it is present in an amount of about 2 g/l.

9. The process as claimed in claim 1 in which sulfamic acid is present in the bath in an amount within the range of 2–10 g/l.

10. The process as claimed in claim 1 in which the salt is present in the bath in an amount less than 50 g/l.

11. The process as claimed in claim 1 in which the color coating is formed to a depth of less than 1 micron.

12. The process as claimed in claim 1 in which the colorless varnish comprises a solution of a colorless acrylic resin.

13. The process as claimed in claim 12 which includes the step of drying the varnish at a temperature within the range of 100°–150° C.

14. A process for electrolytic coloring of objects of aluminum and alloys of aluminum comprising subjecting the objects, without previous anodization, to alternating current, at a voltage below the anodization voltage of the aluminum, while immersed in an aqueous bath having a pH less than 2 and containing sulfamic acid and at least one salt of a metal selected from the group consisting of copper, tin, silver, nickel, and gold, the anion of which is selected from the group consisting of sulfate, sulfamate, and chloride, and then coating the colored surface of the object with a colorless varnish.

* * * * *